United States Patent [19]

Kambic

[11] 3,999,411

[45] Dec. 28, 1976

[54] LOCK KNOB CONTROL MECHANISM

[75] Inventor: Raymond V. Kambic, Joliet, Ill.

[73] Assignee: Folger Adam Co., Division of Telkee, Inc., Joliet, Ill.

[22] Filed: Oct. 24, 1975

[21] Appl. No.: 625,686

[52] U.S. Cl. ..... 70/144; 292/34; 292/165

[51] Int. Cl.[2] ..... E05B 55/00

[58] Field of Search ..... 70/152, 153, 146 R, 70/146 K, 146 Q, 144, DIG. 27, DIG. 36, DIG. 80; 292/33, 34, 35, 37, 40, 165, 177, 180, 139, 140

[56] References Cited

UNITED STATES PATENTS

| | | | |
|---|---|---|---|
| 862,230 | 8/1907 | Young | 70/153 |
| 864,819 | 9/1907 | Young | 70/153 |
| 1,569,228 | 1/1926 | Hurd | 70/153 |
| 2,032,765 | 3/1936 | Rolph | 70/153 |
| 2,800,347 | 7/1957 | Wardinell | 70/146 X |

*Primary Examiner*—J. Franklin Foss
*Attorney, Agent, or Firm*—McCaleb, Lucas & Brugman

[57] ABSTRACT

Lock knob control mechanism comprising a three-piece cam assembly made up of a central cam actuator and two outside knob guides that may be selectively assembled to make the two knobs at opposite sides of a door active or inactive. An inactive knob guide makes its knob nonrotatable. An active knob guide cooperates with the central cam actuator and a locking pawl that prevents rotation of its knob but may be rendered inoperative electrically from a remote point by authorized personnel or mechanically in response to actuation of the key for that lock. The knob control also includes a retainer for securing a knob in place on the door which can be released only when the door is open, with a rose for the knob secured to the door by screws that are covered by the knob so that with the door closed there are no visible means for removing the knob.

9 Claims, 7 Drawing Figures

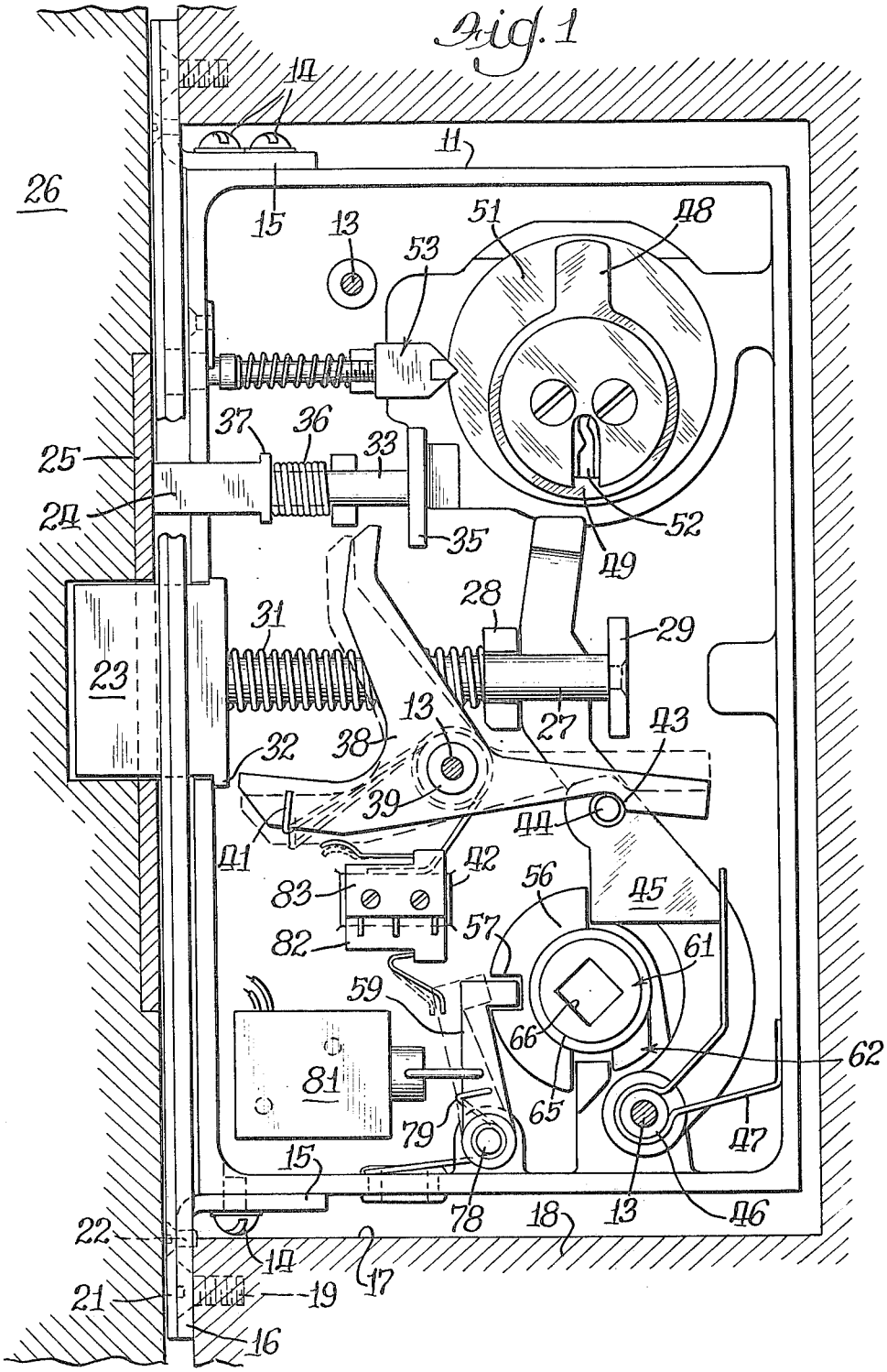
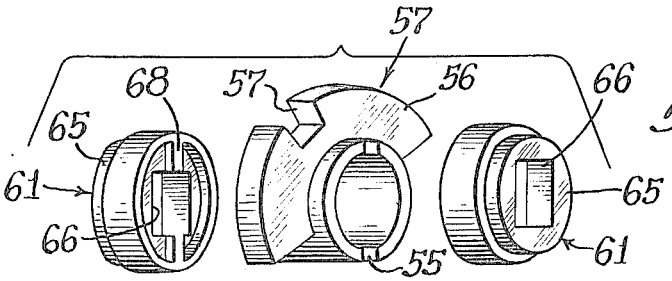
Fig. 2.

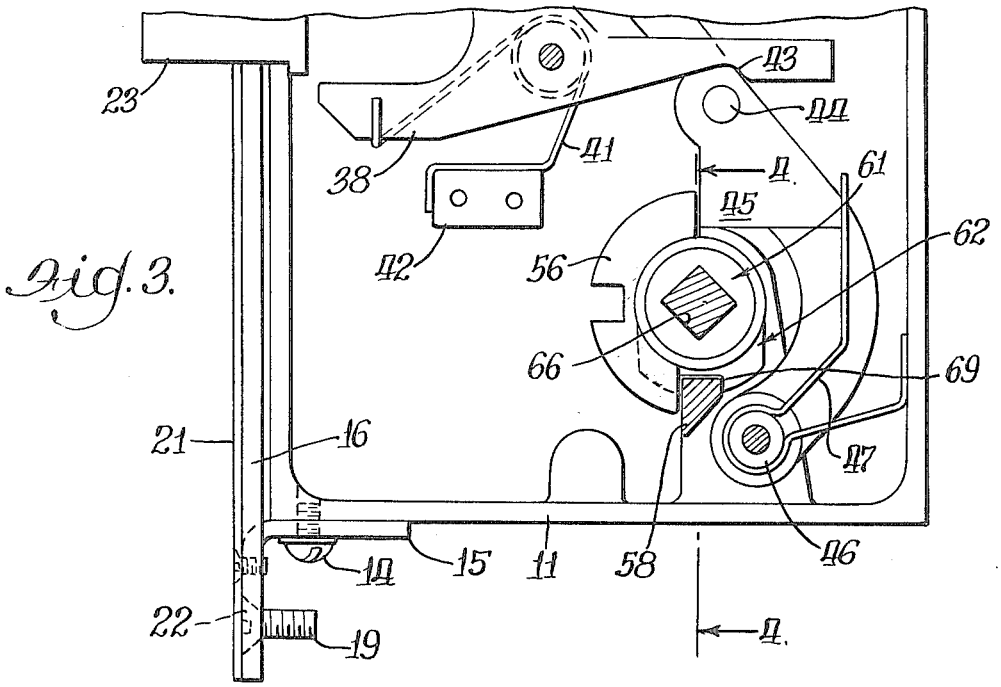
Fig. 3.
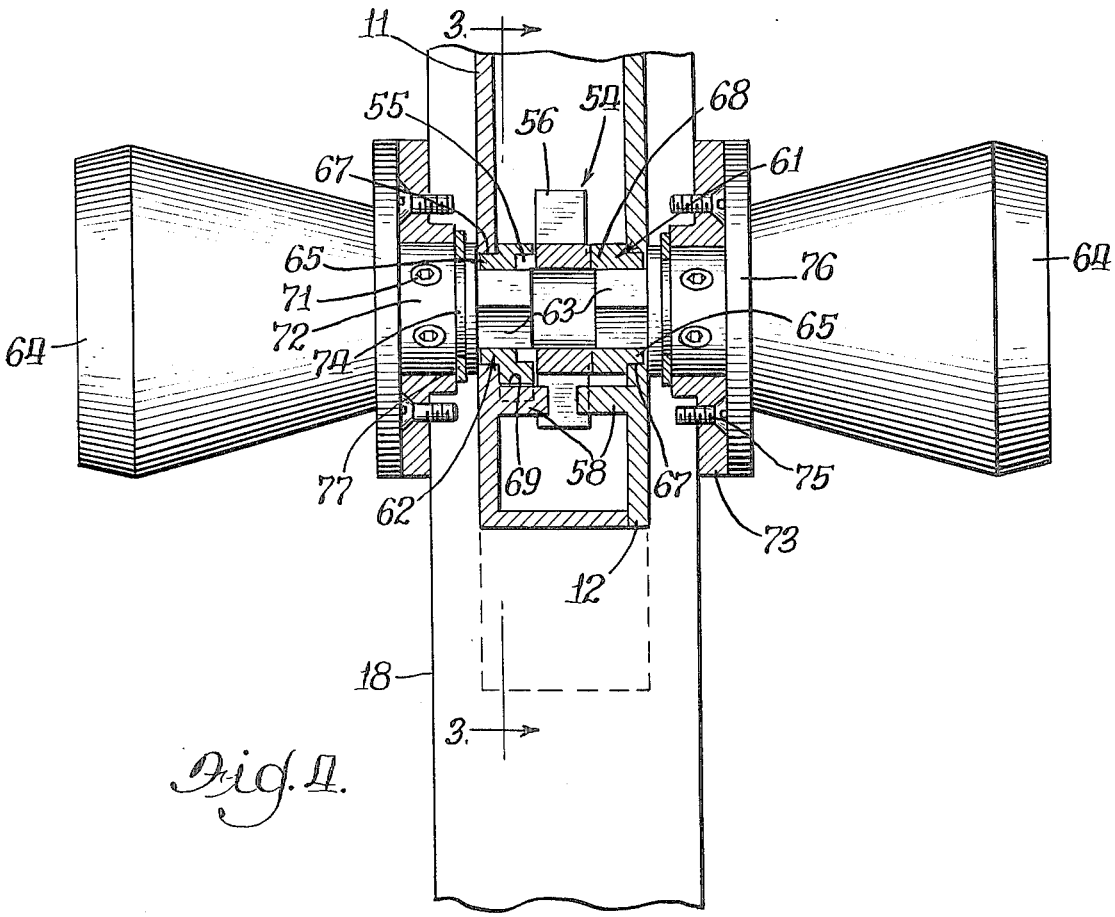
Fig. Д.

Fig. 5.
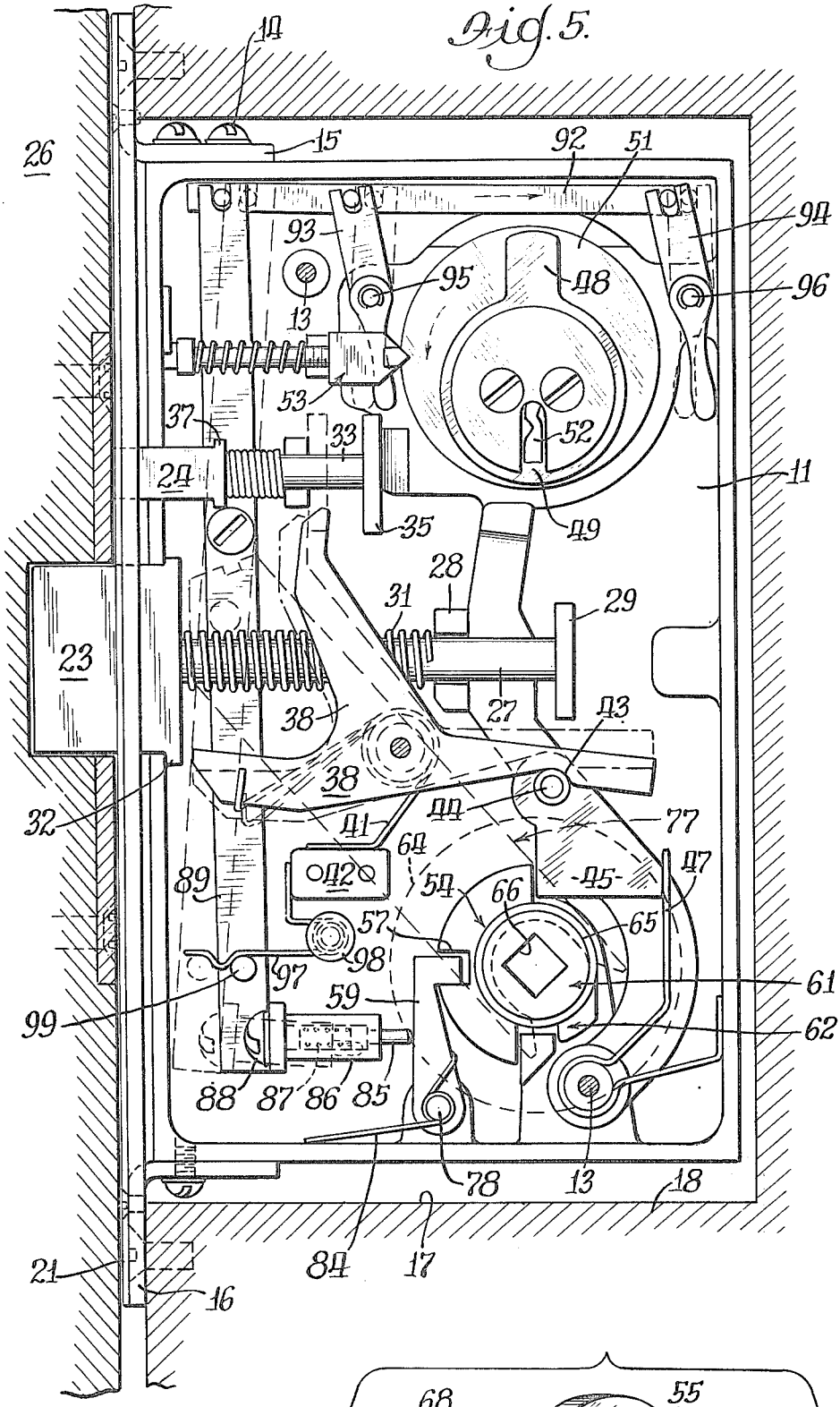
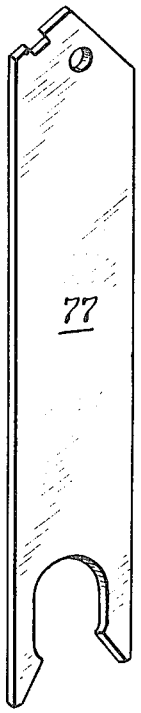
Fig. 7.
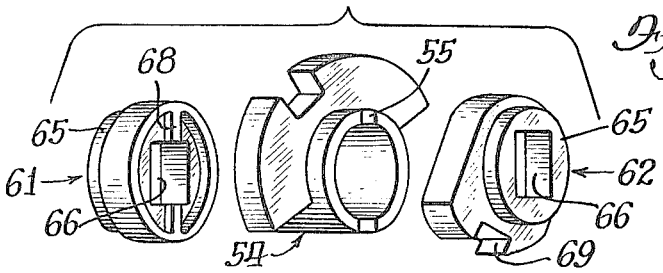
Fig. 6.

LOCK KNOB CONTROL MECHANISM

BACKGROUND OF THE INVENTION

1. Field of the Invention

This invention relates generally to locks and more particularly to novel knob control mechanism for deadlocking locks that preferably have a key-operable cylinder.

2. Description of the Prior Art

In deadlocking locks mounted in a door it is known to employ knob control mechanism comprising a two-piece cam assembly which includes one part operable by an associated knob to unlock the lock, a second part operable by the knob on the other side of the door for the same purpose, and means for preventing operation of that second part which may be rendered inactive by authorized personnel.

SUMMARY OF THE INVENTION

This invention provides novel knob control mechanism by means of which the knobs on the two sides of a door may be either active or inactive and the active knob or knobs may be selectively rendered operable or inoperable by authorized personnel. This knob control mechanism comprises a three-piece cam assembly including a central cam actuator and two outside knob guides cooperating therewith which may be selectively assembled to render their associated knobs active or inactive. The knob engaging an inactive guide is rendered non-rotatable, while a knob engaging an active guide may rotate the cam actuator to unlock the lock if the actuator is operable. A locking pawl may engage the cam actuator to make it inoperable by the knob, and that pawl may be moved to inactive position either in response to an electric signal or mechanically by the lock key to render the cam actuator operable. This three-piece cam assembly thus replaces the two-piece cam assembly of the prior art. If electric control of the cam actuator locking pawl is used, it may be regulated at a point or location remote from the lock. The knob control mechanism also includes a simplified retainer for securing the knob in place which can be released only when the door in which the lock is mounted is open.

In the drawings:

FIG. 1 is a vertical sectional view showing a mounted lock embodying the features of the invention, with the cover of the casing removed;

FIG. 2 is an exploded view of a three-piece cam assembly in perspective which includes two active knob guides;

FIG. 3 is a detail vertical section similar to FIG. 1 and as seen substantially on the line 3—3 of FIG. 4;

FIG. 4 is a detail vertical section taken substantially on the line 4—4 of FIG. 3 showing the knob mounting;

FIG. 5 is a vertical sectional view similar to FIG. 1 showing a key-actuated mechanical means for the knob locking pawl;

FIG. 6 is an exploded view similar to FIG. 2 of a three-piece cam assembly including an active and an inactive knob guide; and FIG. 7 is a perspective view of a knob retainer.

DESCRIPTION OF THE PREFERRED EMBODIMENT

Referring more particularly to FIGS. 1 and 4, the lock is shown as having the usual casing 11 with a cover 12 (FIG. 4) secured thereto by three screws 13 (FIG. 1) and mounted by means of screws 14 between horizontal tabs 15 struck inwardly from a face plate 16. The lock is disposed in a suitable opening 17 in the swingable edge of a door 18, with the end portions of the face plate 16 secured to the door by screws 19. A finish plate 21 is attached to the outer surface of face plate 16, as by means of screws 22, and the casing 11 and plates 16 and 21 have suitable apertures for slidably accommodating the outer ends or heads of a main latch bolt 23 and a trigger bolt 24. A strike plate 25 on the adjacent wall 26 and the wall are suitably apertured to lockingly receive the latch bolt 23.

Latch bolt 23 has an inwardly extending rod 27 slidable between parallel guide lugs 28 formed integrally with the casing 11 and terminates in an end plate 29. A coil spring 31 is mounted on the rod 27 between the guide lugs 28 and the head of bolt 23 to urge the latter outwardly, such motion being limited by flanges 32 on the bolt engaging the edge of the bolt aperture in the casing 11.

Trigger bolt 24 is similarly constructed with a rod 33 slidable between guide lugs 34 on the casing 11, an end plate 35, a coil spring 36 on rod 33 between guide lugs 34 and the head of bolt 24, and flanges 37 on the latter for limiting outward movement of the bolt by contacting the casing 11.

A deadlatch lever 38 is pivotally mounted at 39 in the casing 11 and urged in a clockwise direction, as viewed in FIG. 1, by a grasshopper spring 41 having one end engaging under an outward or forward arm of the lever and its other end contacting a lug 42 on the casing. That forward arm of lever 38 is in its active full line position of FIG. 1, when the door 18 is closed, to prevent unlocking or retraction of the latch bolt 23. Deadlatch lever 38 has an upwardly extending arm which is moved by trigger bolt end plate 35, when the door is open, to its inactive position shown in broken lines in FIG. 1. It will be understood that closing of the door causes retraction of trigger bolt 24 against the action of its spring 36 by the strike plate 25 which is not apertured to receive bolt 24 as it is to receive latch bolt 23. When the door is opened to swing the trigger bolt 24 away from the strike plate, however, spring 36 will overcome spring 41 to retain the deadlatch lever 38 in its broken line inactive position.

A third arm of deadlatch lever 38 extends inward or rearward and is provided with a cam surface 43 on its lower edge that cooperates, when the deadlatch lever is in its active full line position of FIG. 1, with a roll pin 44 on an operating lever 45. This operating lever 45 is pivoted at its lower end on a stud 46 and is urged in a counterclockwise direction by a spring 47 mounted on the stud 46, with one end engaging the casing wall and the other end engaging lever 45 at a point between roll pin 44 and stud 46. The upper portion of operating lever 45 normally is held by spring 47 against the bolt guide lugs 28 and is adapted to be moved against the latch bolt rod end plate 29 to retract the latch bolt 23 against its spring 31. The first increment of such actuating movement of operating lever 45 (clockwise in FIG. 1) causes the roll pin 44 thereon to lift the rear end of deadlatch lever 38 by acting against cam surface 43 to move lever 38 to its inactive position. Thereafter, operating lever 45 contacts plate 29 and unlocks the lock by retracting latch bolt 23.

The operating lever 45 constitutes part of a key-operable mechanism for retracting the bolt 23 which also includes a key-actuated cam 48 secured to a key cylinder 49 mounted in well-known manner in a mogul cylinder 51 for rotation by a suitable key 52. The mogul cylinder is screwed into a tapped aperture in the casing 11 and held against rotation by a cylinder retainer 53. When a proper key 52 is inserted in the cylinder 49 and turned to rotate the latter in a counterclockwise direction as viewed in FIG. 1, the cam 48 strikes the upper end of the lever 45 to move it in a clockwise direction to retract the latch bolt 23 to permit the door 11 to be opened. Thereafter, if the key 52 is turned back to locked position and removed while the door is open, the latch bolt 23 will be moved outwardly by spring 31 and trigger bolt 24 also will be moved outwardly by its spring 36 to hold the deadlatch lever 38 in its inactive broken line position of FIG. 1. This will permit closing of the door to cause retraction of the latch bolt 23 by contact thereof with the strike plate 25. It will be understood that because the latch bolt 23 extends outwardly from the casing 11 and finish plate 21 farther than the trigger bolt 24, the latter is not retracted by contact with the strike plate 25 until after the lower flange 32 of bolt 23 has moved inwardly over the outer end of the deadlatch lever 38 to retain the latter in inactive position until completion of closing of the door permits extension of bolt 23 by spring 31 into locking engagement with the aperture in the strike plate 25. This moves the bolt flange 32 outwardly from engagement with deadlatch lever 38 to permit spring 41 to swing the latter to its full line active position of FIG. 1.

This invention provides knob control mechanism which comprises a three-piece cam assembly that includes a central cam actuator 54 having a hollow cylindrical hub with diametrically opposed and inwardly extending slots 55 in each end (FIG. 2) and a cam 56 having a peripheral notch 57. The upper end of cam 56 cooperates with operating lever 45 to swing the same clockwise from its position of FIG. 1 when the cam actuator 54 is rotated clockwise, and the lower end of cam 56 limits counterclockwise movement of actuator 54 by engaging a lug 58 on casing 11 and a similar companion lug on the cover 12. The peripheral notch 57 is adapted to be engaged by the nose of a pawl 59 to selectively prevent rotation of the cam actuator 54 in a manner later to be described. The knob control mechanism also includes two outside knob guides 61 and 62 for receiving the inner non-circular ends 63 of door knobs 64 and which may be assembled selectively to render the knobs 64 active or inactive. Each of these knob guides 61 and 62, as best seen in FIGS. 2 and 6, respectively, has a peripherally reduced cylindrical outer end 65 through which a non-circular aperture 66 extends for slidably receiving the similarly shaped inner end 63 of a knob 64. When assembled, as best seen in FIG. 4, the outer ends 65 are rotatably disposed in circular apertures 67 extending through the casing 11 and the cover 12. The inner ends of the knob guides 61 and 62 receive and nest with the cylindrical hub of the central cam actuator 54. The active guide 61 has a pair of diametrically opposed and inwardly extending lugs 68 which engage in the slots 55 of cam actuator 54 to prevent relative rotation between the latter and that active guide 61. The inactive guide 62, on the other hand, permits free rotation of the cam actuator 54 relative to it, but is provided with a depending flange having a peripheral slot 69 for engaging one of the casing or cover lugs 58 to prevent its rotation and that of a knob 64 engaging it.

Again referring to FIG. 4, the inner non-circular end 63 of the knob 64 preferably is threaded into a suitable tapped bore in the knob for lengthwise adjustment and secured to the main portion of the knob by set screws 71 extending through a reduced inner collar portion 72. The latter extends through and is supported by a knob rose 73 and is provided near its inner end with an annular groove 74 adjacent the inner end of the rose 73. Screws 75 secure the rose 73 to the skin of the door 18 and are covered by an intermediate portion 76 of the knob. When assembled as shown in FIG. 4, the annular groove 74 is disposed adjacent and exteriorly of the casing 11 and cover 12 to receive a bifurcated end of a knob retainer 77. That knob retainer 77 is illustrated alone in FIG. 7 and is shown in FIG. 5 in broken lines in a normal raised position. Since it is adjacent the inner end of the associated rose 73, it prevents removal of the knob. The retainer lies behind the face plate 16 but its upper end may be rotated downwardly and cleared laterally from the face plate with a proper tool, after removal of the finish plate 21 when the door 18 is open, to enable grasping of the retainer to remove its inner end from the groove 74 and thereby free the knob 64 for removal.

When two active knob guides 61 are assembled with the central cam actuator 54, both knobs 64 are active or operable to rotate their guides 61 and, through them, the cam actuator 54; whereas, assembly of an inactive knob guide 62 with either knob 64 will render that knob inactive or non-rotatable because of the engagement of slot 69 and a lug 58. Thus, as illustrated in FIG. 3, where one active guide 61 and one inactive guide 62 are employed in the three-piece cam assembly, the knob engaging the active guide 61 may be rotated to actuate the operating lever 45, but the knob engaging guide 62 will be non-rotatable. Incidentally, the deadlatch lever 38 is shown in FIG. 3 in its inoperative position which is assumed, as previously described, when the door is open. With the arrangement of FIG. 3, either a key, if a key-operable cylinder is included, or the knob on one side of the door may be employed to withdraw the latch bolt 23 at any time, since the pawl 59 for cooperation with the cam actuator 54 is not included, while the knob on the other side of the door cannot actuate the latch bolt.

In the embodiment of FIG. 1, the pawl 59 is shown pivoted in the casing at 78 at its lower end with a spring 79 urging its nose into engagement with the notch 57 in the central cam actuator 54. The plunger of a solenoid 81 is interconnected with pawl 59 to retract the same from engagement with cam actuator 54 against the action of spring 79 when energized. It will be understood that this is a security measure whereby energization of the solenoid 81 under control of authorized personnel at a point remote from the lock is necessary to render an active knob rotatable. And it can be appreciated that the pawl 59 may be employed as a safety measure or fail-safe mode merely by reversing the direction of actuation of spring 79 to move the pawl 59 out of the cam actuator slot 57 and employing a solenoid energizable to cause its plunger to push the pawl into engagement with slot 57. Power failure then would deenergize the solenoid to permit pawl 59 to be rendered ineffective by its spring to enable rotation of cam actuator 54 by an active knob 64. If desired, a knob lock switch 82 operable by the pawl 59 and a latch bolt switch 83 operable by the deadlatch lever 38 may be mounted as shown in FIG. 1 on the casing lug 42. When operated by pawl 59, switch 82 will cause a signal at a remote control point to indicate that the knob lock is in unlocked or in ineffective position and when operated by deadlach lever 38, switch 83 will cause a signal indicating that door 18 is open.

FIG. 5 illustrates a modified arrangement in which the pawl 59 may be key-actuated into or released from active engagement with the slot 57 of cam actuator 54. In this case, as in the fail-safe modification previously noted, pawl 59 is urged counterclockwise to inactive position by a spring 84 and against a pin 85 slidable in a holder 86 which houses a coil spring 87 urging the pin outwardly and is secured by a screw 88 to the lower end portion of a knob lock lever 89. That lever 89 is pivotally mounted in the casing 11 in any suitable manner at 91 and has a pin and slot connection at its upper end with a link 92 in turn having pin and slot connections with the upper ends of parallel cam-actuated levers 93 and 94 which are pivotally mounted at 95 and 96, respectively, at opposite sides of the mogul cylinder 51. The key-actuated cam 48 when moved counterclockwise in FIG. 5 in unlocking direction will strike the lower end of lever 93 to move it and the interconnected link 92 and lever 89 from their full line active positions to their broken line inactive positions. When the key 52 is turned in the opposite direction to move cam 48 clockwise from normal locked position, the latter will strike the lower end of lever 94 to return it and lever 89 to their full line active positions. The linkage comprising members 89, 92–94 is resiliently retained in either active or inactive position by a detent spring 97 which is suitably mounted at 98 and engages a pin 99 secured to the knob lock lever 89.

When lever 89 thus is swung to its full line active position, the pin 85 will move the upper end of knob lock pawl 59 into the slot 57 to prevent rotation of an active knob. If it should happen that the slot 57 is not properly aligned with the nose of pawl 59 during such key-actuated movement of lever 89, spring 87 will be compressed to prevent damage to the parts, the lever 89 will be retained by spring detent 97 in active position even if the key and cam 48 are returned to the normal locked condition of FIG. 5, and release of the active knob will enable return of operating lever 45 to normal position by spring 47 which will align notch 57 with the nose of pawl 59 to allow spring 87 to swing the latter to locking position.

The embodiments of the invention in which an exclusive property or privilege is claimed are defined as follows:

1. In a lock having a casing mountable in a door, a latch bolt mounted in and extending from said casing, deadlatch mechanism operative when the door is closed to prevent retraction of said bolt, key-operable mechanism for rendering said deadlatch mechanism inoperative and retracting said bolt, and a knob mounted on said lock at each side of the door; knob control mechanism, comprising a three-piece cam assembly mounted in said casing having a central cam actuator and two outside knob guides for receiving the inner ends of said knobs and which may be assembled to render said knobs active or inactive.

2. A lock according to claim 1, wherein said casing is provided with inwardly extending lug means cooperable with an inactive said knob guide to prevent rotation thereof.

3. A lock according to claim 1, wherein said central cam actuator is provided with an inwardly extending slot in each end, and an active said knob guide has axially extending lug means matingly engageable with a said slot to prevent relative rotation of said cam actuator and a said active knob guide.

4. A lock according to claim 3, wherein rotation of said cam actuator by a said active knob guide and its knob renders said deadlatch mechanism inoperative and retracts said bolt.

5. A lock according to claim 4, wherein said cam actuator is provided with a peripheral notch, and a pawl engageable with said notch to prevent rotation of said cam actuator and said pawl is mounted for pivotal movement, a spring urging said pawl in one direction and a solenoid energizable to move said pawl in the opposite direction against the action of said spring.

6. A lock according to claim 5, wherein said pawl is mounted for pivotal movement, a spring urging said pawl to inactive position, and key-actuated mechanism operable to an active position for moving said pawl into active position in engagement with said notch against the action of said spring.

7. A lock according to claim 6, wherein said key-actuated mechanism is operable to an inactive position to enable said spring to move said pawl to inactive position, and detent means for maintaining said key-actuated mechanism in active or inactive position.

8. In a lock having a casing mountable in a door, a latch bolt mounted in and extending from said casing, deadlatch mechanism operative when the door is closed to prevent retraction of said bolt, key-operable mechanism for rendering said deadlatch mechanism inoperative and retracting said bolt, and a knob mounted on said lock at each side of the door; knob control mechanism, comprising a three-piece cam assembly mounted in said casing having a central cam actuator and two outside knob guides for receiving the inner ends of said knobs and which may be assembled to render said knobs active or inactive, wherein said casing includes a front face plate for mounting the same on said door, and at least one of said knobs is provided adjacent its inner end with an annular groove disposed exteriorly of said casing behind said face plate when mounted thereon, and a retainer engageable in said groove behind said face plate for securing said knob in place on said door and thereby releasable from said groove only when said door is open.

9. In a lock according to claim 8, a rose for receiving a said knob and rotatably supporting the same, and screws securing said rose to said door, an intermediate portion of said knob covering said screws when the knob is mounted therein, whereby no means for removing said knob are visible with the door closed.

* * * * *